US010147372B2

(12) United States Patent
Wu et al.

(10) Patent No.: US 10,147,372 B2
(45) Date of Patent: Dec. 4, 2018

(54) DRIVING CIRCUITS OF LIQUID CRYSTAL PANELS AND THE DRIVING METHOD THEREOF

(71) Applicant: Shenzhen China Star Optoelectronics Technology Co., Ltd., Shenzhen, Guangdong (CN)

(72) Inventors: Jingjing Wu, Guangdong (CN); Zhi Xiong, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 304 days.

(21) Appl. No.: 14/759,907

(22) PCT Filed: Jun. 5, 2015

(86) PCT No.: PCT/CN2015/080879
§ 371 (c)(1),
(2) Date: Jul. 8, 2015

(87) PCT Pub. No.: WO2016/179868
PCT Pub. Date: Nov. 17, 2016

(65) Prior Publication Data

US 2016/0335947 A1 Nov. 17, 2016

(30) Foreign Application Priority Data

May 14, 2015 (CN) ..... 2015 1 0246070

(51) Int. Cl.
*G09G 3/20* (2006.01)
*G09G 3/36* (2006.01)

(52) U.S. Cl.
CPC ..... *G09G 3/3614* (2013.01); *G09G 3/3607* (2013.01); *G09G 3/3688* (2013.01);
(Continued)

(58) Field of Classification Search
CPC .. G09G 3/3614; G09G 3/3607; G09G 3/3688; G09G 3/2018; G09G 2310/0251;
(Continued)

(56) References Cited

U.S. PATENT DOCUMENTS 4,651,148 A * 3/1987 Takeda ..... G02F 1/133514 345/208
6,307,681 B1 * 10/2001 Aoki ..... G09G 3/3648 340/14.1

(Continued)

*Primary Examiner* — Amare Mengistu
*Assistant Examiner* — Crystal A Mathews
(74) *Attorney, Agent, or Firm* — Andrew C. Cheng

(57) ABSTRACT

The present disclosure relates to a driving circuit and a driving method of liquid crystal panels. The driving circuit includes a timing control chip receiving video signals and analyzing frame turn-on signals and column data voltage signals corresponding to a needed grayscale, calculating a pre-charge time period needed for the subpixels to be displayed in a real-time manner and obtaining pre-charge control signals in accordance with the pre-charge time period. The driving circuit also includes a scanning driving circuit receiving the frame turn-on signals and generating the row-scanning-driving voltage signals, overlapping the pre-charge control signals and the row-scanning-driving voltage signals to obtain the row-scanning-driving signals, and transforming the row-scanning-driving signals into row-scanning-driving voltage, then transmitting the row-scanning-driving voltage to a corresponding scanning line. In this way, the power consumption and the temperature of the driving circuit are reduced, and the sharpness of the display images is enhanced.

12 Claims, 6 Drawing Sheets

(52) U.S. Cl.
CPC ... *G09G 3/2018* (2013.01); *G09G 2310/0251* (2013.01); *G09G 2310/0286* (2013.01); *G09G 2310/06* (2013.01); *G09G 2310/067* (2013.01); *G09G 2310/08* (2013.01); *G09G 2330/021* (2013.01); *G09G 2340/16* (2013.01); *G09G 2360/16* (2013.01)

(58) Field of Classification Search
CPC ..... G09G 2310/06; G09G 2310/067; G09G 2310/08; G09G 2330/021; G09G 2340/16; G09G 2360/16
See application file for complete search history.

(56) References Cited

U.S. PATENT DOCUMENTS 7,095,393 B2 * 8/2006 Lee ..... G09G 3/3648 345/204
8,581,822 B2 * 11/2013 Chuang ..... G09G 3/3648 345/94
2002/0154085 A1 * 10/2002 Kim ..... G02F 1/134336 345/92
2005/0195671 A1 * 9/2005 Taguchi ..... G02F 1/13306 365/203
2005/0237831 A1 * 10/2005 Ishii ..... G09G 3/20 365/201
2006/0145991 A1 * 7/2006 Jang ..... G09G 3/3677 345/94
2006/0176265 A1 * 8/2006 Kim ..... G09G 3/3648 345/100
2007/0001991 A1 * 1/2007 Jang ..... G09G 3/3677 345/100
2009/0009498 A1 * 1/2009 Nishimura ..... G09G 3/3688 345/205
2010/0315403 A1 * 12/2010 Kaneyoshi ..... G09G 3/3614 345/211
2011/0170014 A1 * 7/2011 Irie ..... G09G 3/3614 348/731
2011/0221729 A1 * 9/2011 Chuang ..... G09G 3/3648 345/211
2014/0118331 A1 * 5/2014 Jeon ..... G09G 3/3614 345/213
2014/0168281 A1 * 6/2014 Ahn ..... G09G 3/3648 345/690
2015/0009196 A1 * 1/2015 Lin ..... G09G 3/3696 345/211
2015/0035866 A1 * 2/2015 Ahn ..... G09G 5/10 345/690
2015/0116386 A1 * 4/2015 Shin ..... G09G 3/3688 345/694
2015/0187297 A1 * 7/2015 Park ..... G09G 3/3677 345/99
2015/0194119 A1 * 7/2015 Ahn ..... G09G 3/3696 345/213
2016/0118002 A1 * 4/2016 Ito ..... G09G 3/3614 345/96
2016/0189603 A1 * 6/2016 Lee ..... G09G 3/3258 345/212
2016/0358529 A1 * 12/2016 Kim ..... G09G 3/2018

* cited by examiner

DRIVING CIRCUITS OF LIQUID CRYSTAL PANELS AND THE DRIVING METHOD THEREOF

BACKGROUND OF THE INVENTION

1. Field of the Invention

The present disclosure relates to liquid crystal display technology, and more particularly to a driving circuit of liquid crystal panels and the driving method thereof.

2. Discussion of the Related Art

A driving circuit having a resolution of 720*1280 of liquid crystal panels is shown as in FIG. 1 as an example. The driving circuit 10 includes a plurality of scanning lines (X) arranged along a row direction, and the scanning lines (X) are parallel to each other. In FIG. 1, there are 2160 scanning lines (X). The driving circuit 10 also includes a plurality of data lines (Y) parallel to each other. In FIG. 1, there are 3840 columns. The data line (Xm) and the scanning line (Ym) intersect with each other, wherein m is a positive integer in a range between 1 and 2160, and n is a positive integer in a range between 1 and 3840. A plurality of subpixels 110 are arranged at the intersections of the scanning lines (X) and the data lines (Y). Specifically, each of the subpixels 110 includes a field effect tube (FET) (T) and a capacitor unit (A), which is also known as pixel electrode. The FET (T) includes a gate (G), a source (S), and a drain (D). The capacitor (A) includes liquid crystal capacitor (Clc) and a storage capacitor (Cs). One end of the storage capacitor (Cs) connects to the drain (D) and the source (S). As shown in FIG. 1, one end of the storage capacitor (Cs) connects to the drain (D), and the other end of the storage capacitor (Cs) connects to the common voltage (Vcom). The gate (G) of the FET (T) of the subpixels 110 in the same row connects to the corresponding scanning line (X). Similarly, the source (S) of the FET (T) of the subpixels 110 in the same column connect to the corresponding data line (Y). In this way, the gate (G) of the subpixels 110 may be turned on or off by configuring the scanning voltage (VGm) of the scanning line (Xm) to be high or low. When the VGm is turned on, the data voltage (VSn) of the data line (Y) of the subpixels 110 in the column may be received such that the drain (D) or the capacitor unit (A) may be charged and the data voltage corresponding to the grayscale may be received. In this way, the subpixels 110 displays images corresponding to the grayscale when being driven by the voltage of the scanning line (X) and the data line (Y). The scanning lines (X) are turned on in sequence, and the data voltage for displaying the grayscale is written via the data line (Y) such that the images may be displayed normally.

In order to avoid the direct-current blocking effect and the direct-current residual effect of the liquid crystal panels, an alternating current (AC) voltage has to be applied to two ends of the liquid crystal. The common electrode (Vcom) is the reference voltage of the AC voltage. That is, the data voltage (VSn) owns a positive polarity and a negative polarity. In FIG. 1, VDDA owns positive polarity when comparing to the Vcom, and VSSA owns the negative polarity when comparing to the Vcom. Thus, during the driving operations of the liquid crystal panel, the drain voltage ($V_D$), which is also called as pixel voltage, is charged from a positive polarity to a negative polarity and then from the negative polarity to the positive polarity by the data voltage of the data line (Y). Thus, the charging process has to be completed during the turn-on time period of the FET (T) of each of the scanning line (Xm). In order to achieve this object, during the pre-charge operations, the data voltage (VSn) of the previous row having the same polarity has to be applied to the current row, and thus the polarity of the drain voltage ($V_D$) of the subpixels 110 of the current row is inversed, which ensures the liquid crystal capacitor (Clc) can quickly achieve the voltage level corresponding to the grayscale needed. In addition, due to the increasing resolution and the refresh rate of the liquid crystal panel, the turn-on time period for each of the scanning line (Xm) is greatly reduced, which results in insufficient charging time period.

FIGS. 2, 3, 4*a*, and 4*b* relate to the conventional driving method having the same predetermined pre-charge time period. FIG. 2 is a schematic view of the pre-charge scanning voltage waveforms for dot inversion and column inversion of FIG. 1, wherein CKV represents the clock pulse control signals and Gm represents the pre-charge scanning voltage waveform corresponding to the scanning line (Xm). Gm may also be called as row-scanning-driving voltage signals, and may be converted into row scanning voltage (VGm). Before the data voltage (VSn) for displaying corresponding grayscale is inputted to the data line (Y), the scanning line (X) is turned on to apply the pre-charge operations to the subpixels 110 to be displayed. For instance, during the time period (t2), the voltage waveforms corresponding to G1 and G2 turn on the subpixels 110 corresponding to the scanning lines (X1, X2). At this moment, as shown in FIG. 4*b*, the data voltage (V2) corresponding to the subpixels $\mathbf{110}_{(1,1)}$ is inputted to the data line (Y1) of the subpixels $\mathbf{110}_{(2,1)}$ in the same column and in the next row. This operation pre-charge the subpixels $\mathbf{110}_{(2,1)}$ in the X2 row, and the polarity of the data voltage (V1), as shown in FIG. 4*a*, is charged by the data voltage (V2) corresponding to the subpixels $\mathbf{110}_{(1,1)}$ and then is inversed. During the time period (t3), the data voltage (V3) needed for displaying the corresponding grayscale of the subpixels $\mathbf{110}_{(2,1)}$ is written. FIG. 3 is an example, wherein V2>V3>V1. This method intends to reduce the charging time period needed for inversing the negative polarity of the previous frame to the positive polarity, wherein the polarity of V3 is positive in view of Vcom. However, as the pre-charge time period (t2) is a fixed value, such as a clock period (CKV) shown in FIG. 2, the subpixels $\mathbf{110}_{(2,1)}$ may reach the data voltage level of V2 during the time period (t2). When writing the data voltage (V3) corresponding to the needed grayscale, the V2 drops to be V3, which extends the pre-charge time period to be t4. This has not achieved the object of reducing the charging time period. On the contrary, the pre-charge time period is increased.

Such pre-charge method pre-charges the subpixels 110 on each of the scanning lines (X), and the pre-charge time period are the same. That is, t1=t2=t3=. . . tm. As the data voltage corresponding to the subpixels 110 in the previous row is charged to the subpixels 110 in the current row and in the same column, some of the frames that are not needed to be pre-charged may be turned on or the pre-charge time period for some of the frames is too long, which results in higher power consumption and higher temperate of the driving circuit. At the same time, as the scanning line (X) is turned on in advance, the abnormal data voltage may be written into the liquid crystal panel, which results in a bad sharpness of the display images.

In view of the above, conventional technology cannot satisfy the demands toward low power consumption and high sharpness of the liquid crystal panels.

SUMMARY

The present disclosure relates to a driving circuit of the liquid crystal panels and the driving method thereof. The driving circuit may calculate the pre-charge time period for the subpixels in a real-time manner. In this way, the power consumption and the temperature of the driving circuit is reduced, and the sharpness of the display images is enhanced.

In one aspect, a driving circuit of liquid crystal panels includes: a timing control chip receiving video signals and analyzing frame turn-on signals and column data voltage signals corresponding to a needed grayscale, extracting the column data voltage signals of the subpixels of a previous frame to be displayed in a real-time manner to calculate a first data voltage, extracting the column data voltage signals of the subpixels of the current frame to be displayed in the real-time manner to calculate a second data voltage, the subpixels being located in a previous column and in the corresponding same row, and extracting the column data voltage signals of the current frame of the subpixels to be displayed in the real-time manner to calculate a third data voltage from the analyzed column data voltage signals; calculating a pre-charge time period needed for charging from the first data voltage to the third data voltage in accordance with the second data voltage in the real-time manner so as to adopt the pre-charge time period as a time period of the pre-charge control signals to obtain pre-charge control signals; a scanning driving circuit comprising a shift register, a logic operator, and a potential shifter, the shift register receiving the frame turn-on signals and generating the row-scanning-driving voltage signals, the logic operator receiving the pre-charge control signals and overlapping the pre-charge control signals and the row-scanning-driving voltage signals to obtain the row-scanning-driving signals, and the scanning driving circuit transforming the row-scanning-driving signals to the row-scanning-driving voltage so as to transmit the row-scanning-driving voltage to a corresponding scanning line.

In another aspect, a driving circuit of liquid crystal panels includes: a timing control chip receiving video signals and analyzing frame turn-on signals and column data voltage signals corresponding to a needed grayscale; calculating a pre-charge time period needed for displaying the subpixels to be displayed in a real-time manner in accordance with the column data voltage signals, and obtaining pre-charge control signals in accordance with the pre-charge time period; a scanning driving circuit receiving the frame turn-on signals and generating the row-scanning-driving voltage signals, receiving the pre-charge control signals and overlapping the pre-charge control signals and the row-scanning-driving voltage signals to obtain the row-scanning-driving signals, and transforming the row-scanning-driving signals to the row-scanning-driving voltage so as to transmit the row-scanning-driving voltage to a corresponding scanning line.

Wherein the timing control chip extracts the column data voltage signals of the subpixels of a previous frame to be displayed in a real-time manner to calculate a first data voltage, extracts the column data voltage signals of the subpixels of the current frame to be displayed in the real-time manner to calculate a second data voltage, the subpixels being located in a previous column and in the corresponding same row, extracts the column data voltage signals of the current frame of the subpixels to be displayed in the real-time manner to calculate a third data voltage from the analyzed column data voltage signals, and calculates the pre-charge time for charging from the first data voltage to the third data voltage in accordance with the second data voltage in the real-time manner, and the pre-charge time period is adopted as the a time period of the pre-charge control signals to obtain pre-charge control signals.

Wherein the scanning driving circuit includes a shift register, a logic operator, and a potential shifter, the shift register receiving the frame turn-on signals and generating the row-scanning-driving voltage signals, the logic operator receiving the pre-charge control signals and overlapping the pre-charge control signals and the row-scanning-driving voltage signals to obtain the row-scanning-driving signals, and the scanning driving circuit transforming the row-scanning-driving signals to the row-scanning-driving voltage so as to transmit the column-scanning-driving voltage to a corresponding scanning line.

Wherein the scanning driving circuit further includes an output buffer enhancing a driving capability of the row-scanning-driving voltage and transmitting the enhanced row-scanning-driving voltage to the corresponding scanning line.

Wherein the driving circuit further includes a data driving circuit receiving the column data voltage signals, transforming the column data voltage signals to the data voltage, and transmitting the data voltage to the data line.

In another aspect, a driving method of liquid crystal panels includes: (S1) receiving video signals by a driving circuit and analyzing frame turn-on signals and column data voltage signals corresponding to a needed grayscale; (S2) calculating a pre-charge time period needed for the subpixels to be displayed in accordance with the column data voltage signals in a real-time manner, and obtaining the pre-charge control signals in accordance with the pre-charge time period; (S3) generating row-scanning-driving voltage signals in accordance with the frame turn-on signals; (S4) overlapping the pre-charge control signals and the column scanning driving voltage signals, and transforming the row-scanning-driving signals to the row-scanning-driving voltage; and (S5) transmitting the row-scanning-driving voltage to a corresponding scanning line.

Wherein the step (S2) further includes: extracting the column data voltage signals of the subpixels of a previous frame to be displayed in a real-time manner to calculate a first data voltage, extracting the column data voltage signals of the subpixels of the current frame to be displayed in the real-time manner to calculate a second data voltage, the subpixels being located in a previous column and in the corresponding same row, and extracting the column data voltage signals of the current frame of the subpixels to be displayed in the real-time manner to calculate a third data voltage from the analyzed column data voltage signals; calculating a pre-charge time period needed for charging from the first data voltage to the third data voltage in accordance with the second data voltage in the real-time manner so as to adopt the pre-charge time period as a time period of the pre-charge control signals to obtain pre-charge control signals.

Wherein the step (S4) further includes: (S41) overlapping the pre-charge control signals and row-scanning-driving voltage signals to obtain the row-scanning-driving signals; and (S42) transforming the row-scanning-driving signals to the row-scanning-driving voltage.

Wherein after the step (S42), the method further includes step (S43) of enhancing a driving capability of the row-scanning-driving voltage.

Wherein after the step (S1) and before the step (S5), the method further includes:

(S6) transforming the row-scanning-driving signals to the row-scanning-driving voltage so as to transmit the column-scanning-driving voltage to a corresponding scanning line.

In view of the above, the timing control chip of the driving circuit receives video signals and analyzed the frame turn-on signals and column data voltage signals corresponding to a needed grayscale. The timing control chip calculates the pre-charge time period needed to display the subpixels in a real-time manner in accordance with the column data voltage signals. Further, the pre-charge control signals is obtained in accordance with the pre-charge time period. The scanning driving circuit receives the frame turn-on signals and generates the row-scanning-driving voltage signals. The scanning driving circuit further receives the pre-charge control signals and overlaps it with the scanning driving signals. The scanning driving circuit transforms the row-scanning-driving signals to the row-scanning-driving voltage so as to transmit the row-scanning-driving voltage to a corresponding scanning line. The pre-charge time period for the subpixels is calculated in the real-time manner, and thus the pre-charge time period for each row are prevented from over-charge. In this way, the power consumption and the temperature of the driving circuit is reduced, which overcomes the sharpness issue caused by turning on the scanning line in advance.

DETAILED DESCRIPTION OF THE EMBODIMENTS

Embodiments of the invention will now be described more fully hereinafter with reference to the accompanying drawings, in which embodiments of the invention are shown.

Figure 5:
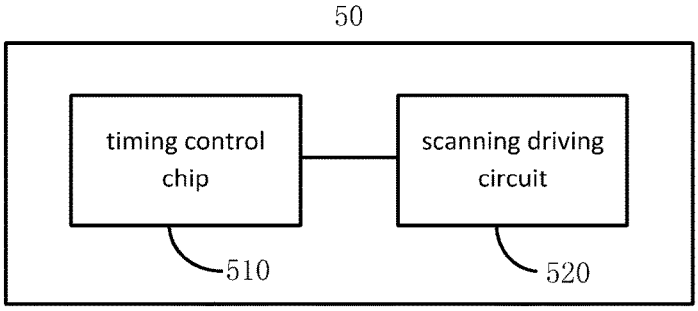
FIG. 5 is a schematic view of the driving circuit of the liquid crystal panel in accordance with a first embodiment.

FIG. 5 is a schematic view of the driving circuit of the liquid crystal panel in accordance with a first embodiment. The driving circuit 50 includes the following components.

A timing control chip 510 receives video signals and analyzes frame turn-on signals (STV) and corresponding grayscale column data voltage signals (Sn), wherein Sn is an exemplary data voltage waveform corresponding to the data line (Yn) located in the n-th column. The timing control chip 510 calculates the column data voltage signals (Sn) in a real-time manner to obtain a pre-charge time period (Tm) needed to display the sub-pixel 110, wherein m represents the scanning line (Xm) located in the m-th row has to be connected so as to display the sub-pixel unit 110. In addition, the pre-charge control signals (PCC) may be obtained in accordance with the pre-charge time period (Tm).

A scanning driving circuit 520 receives the frame turn-on signals (STV) to generate row-scanning-driving voltage signals (gm), and receives the pre-charge control signals (PCC). The scanning driving circuit 520 overlaps the pre-charge control signals (PCC) and the row-scanning-driving voltage signals (gm) and transforms into a row-scanning-driving voltage (VGm). Afterward, the row-scanning-driving voltage (VGm) is transmitted to the corresponding scanning line (Xm).

The pre-charge control signals (PCC) includes the row-pre-charge control signals (PCCm) for all of the sub-pixel units 110 of the current frame. The row-pre-charge control signals (PCCm) may be obtained by the pre-charge time period (Tm) of the current sub-pixel unit 110, wherein the pre-charge time period (Tm) is adopted as the time period (or the width of the pulse) of the row-pre-charge control signals (PCCm), and the high-level voltage or voltage signals are the same with the row-scanning-driving voltage signals (gm).

In other examples, the timing control chip 510 may obtain the row-pre-charge control signals (PCCm) in accordance with the pre-charge time period (Tm). The scanning driving circuit 520 receives the row-pre-charge control signals (PCCm). The timing control chip 510 overlaps the row-scanning-driving voltage signals (gm) and the row-pre-charge control signals (PCCm) and transforms into the row-scanning-driving voltage (VGm). Afterward, the row-scanning-driving voltage (VGm) is transmitted to the corresponding scanning line (Xm).

Figure 1:
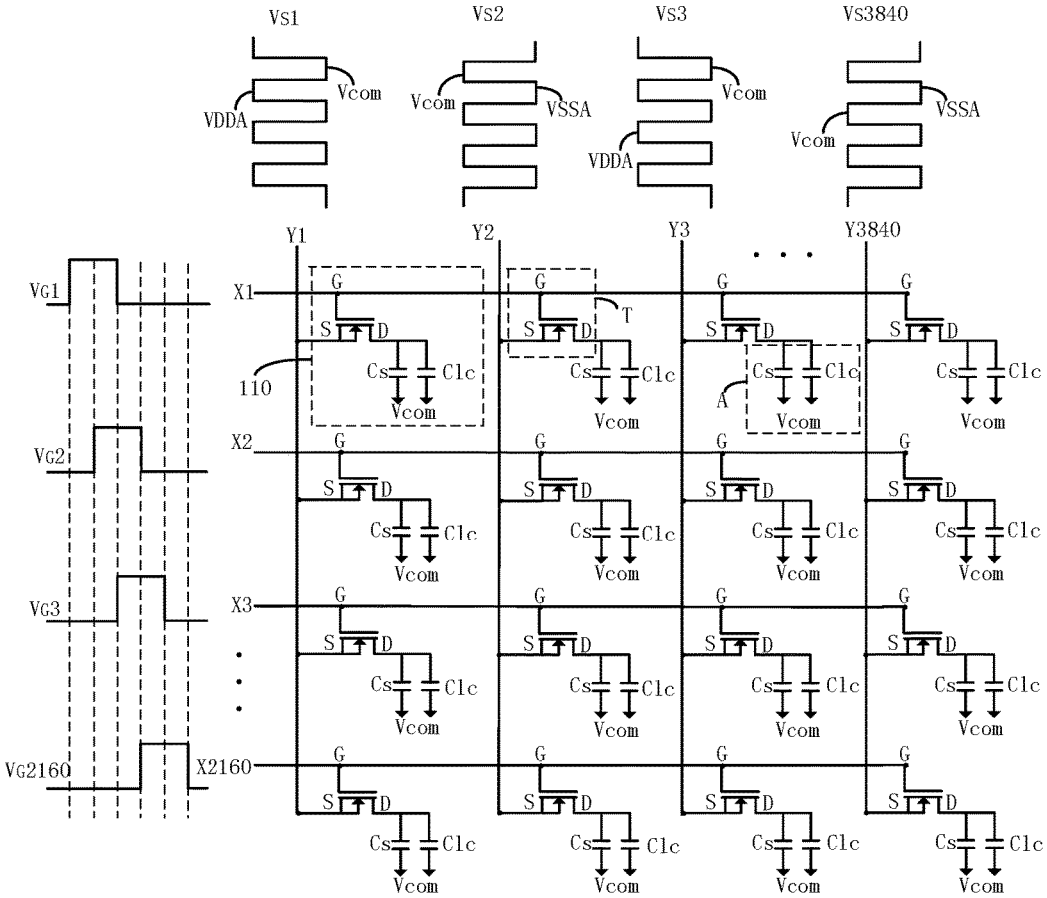
FIG. 1 (Prior Art)
FIG. 1 is a schematic view of a conventional driving circuit of liquid crystal panel.
Figure 2:
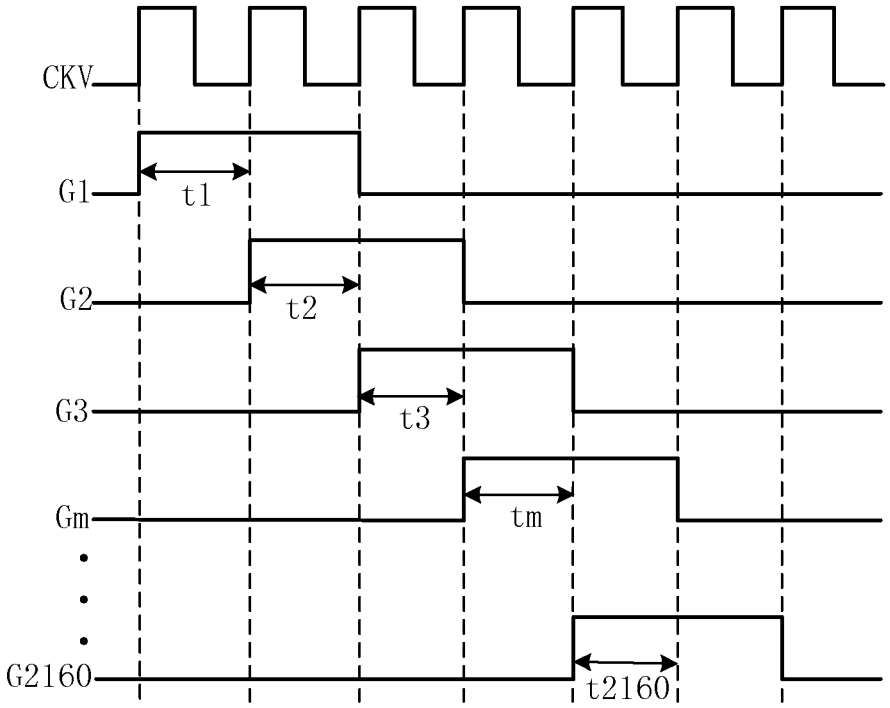
FIG. 2 (Prior Art)
FIG. 2 is a schematic view of the pre-charge scanning voltage waveforms for dot inversion and column inversion of FIG. 1.
Figure 3:
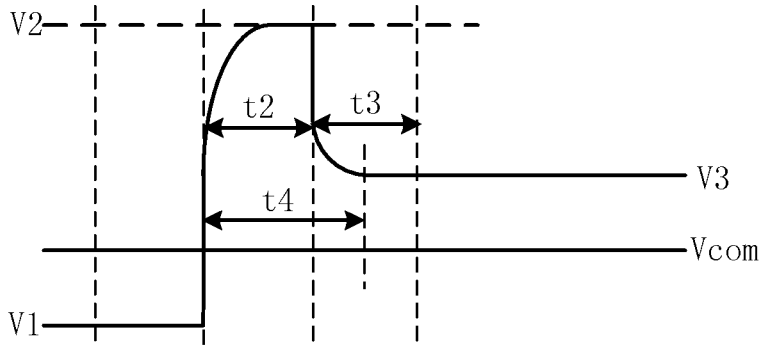
FIG. 3 (Prior Art)
FIG. 3 is a schematic view of the charging process of the subpixels needed to be displayed of the current frame of FIG. 2.
Figure 4A:
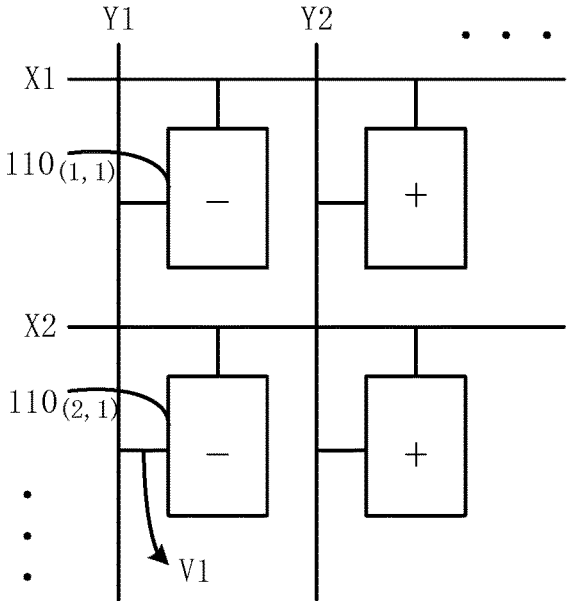
FIG. 4a (Prior Art)
FIG. 4*a* is a schematic view of the liquid crystal polarity of the data voltage of the subpixels needed to be displayed of the previous frame of FIG. 3.
Figure 4B:
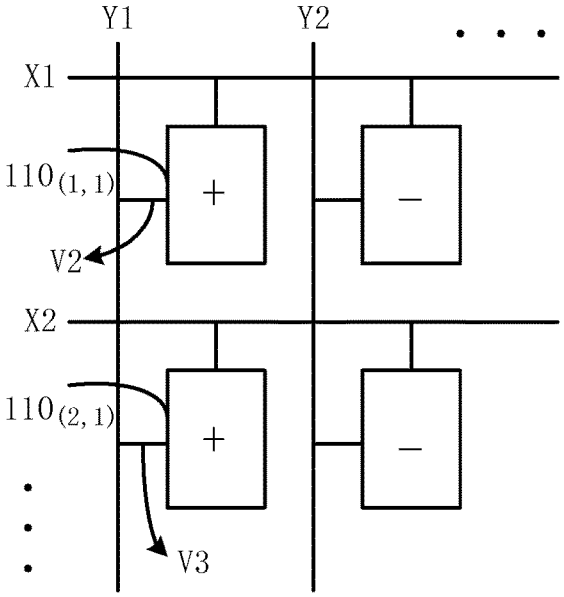
FIG. 4b (Prior Art)
FIG. 4*b* is a schematic view of the liquid crystal polarity of the data voltage of the subpixels needed to be displayed of the current frame of FIG. 3.

Referring to FIG. 1 or FIG. 4*a* or 4*b*, conventionally, the sub-pixel units 110 in each row has the same pre-charge time period. In the embodiment, the pre-charge time period (Tm) for the sub-pixel unit 110 may be obtained in the real-time manner in accordance with the column data voltage signals (Sn). Referring to FIGS. 4*a* and 4*b*, the subpixel $\mathbf{110}_{(2,1)}$ in the second row is taken as an example. The charge time needed for charging V1 to V3 is calculated in accordance with the data voltage of the previous frame (V1) and the data voltage (V3) of the current frame, wherein V1 is obtained by the column-data voltage (S1) of the previous frame and V3 is obtained by the column-data voltage (S1) of the current frame. The charge time is adopted as the pre-charge time period (T2). The pre-charge time period (T2) may be adopted as the time period of charging control signals to obtain the pre-charge control signals (PCC2). Similarly, the pre-charge time period (Tm) of the sub-pixel unit 110 located in each of the rows of the current frame may be calculated so as to obtain the row-pre-charge control signals (PCCm) for the sub-pixel unit 110 located in each of the rows.

Figure 6:
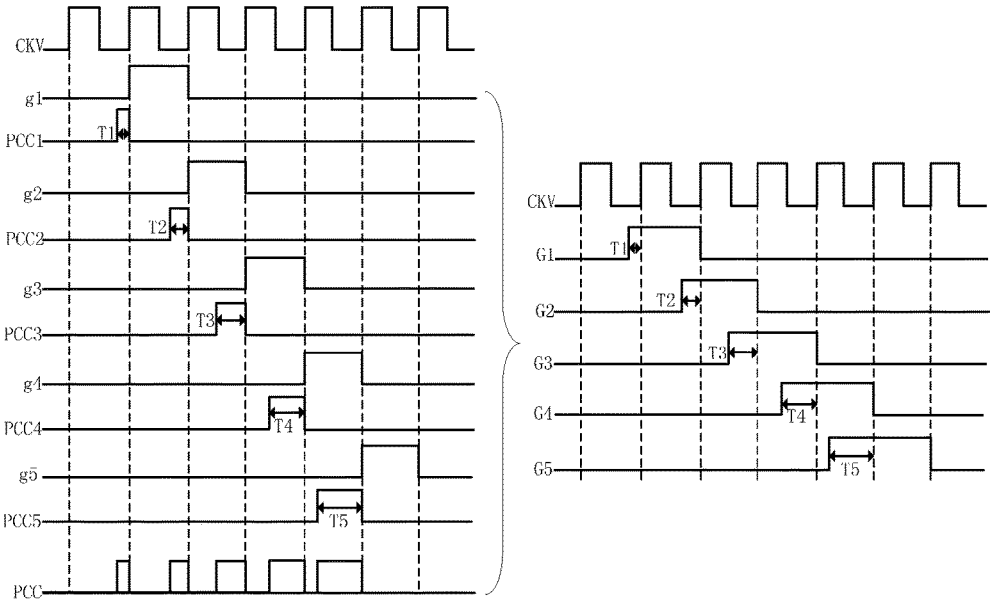
FIG. 6 is a schematic view of the pre-charge scanning voltage waveforms for dot inversion and column inversion of FIG. 5.
Figure 7:
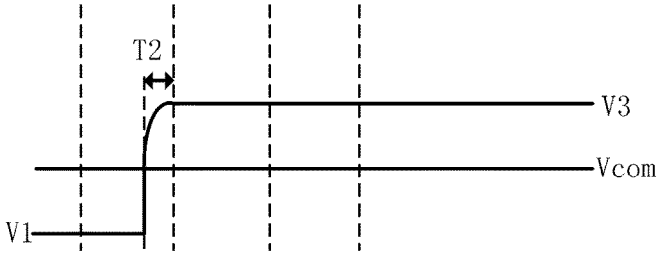
FIG. 7 is a schematic view of the charging process of the subpixels needed to be displayed of the current frame of FIG. 6.

Referring to FIGS. 6 and 7, FIG. 6 is a schematic view of the pre-charge scanning voltage waveforms for dot inversion and column inversion of FIG. 5. FIG. 7 is a schematic view of the charging process of the subpixels needed to be displayed of the current frame of FIG. 6.

As shown in FIG. 6, five exemplary row-scanning-driving voltage signals (gm) are shown. The display module 120 receives the frame turn-on signals (STV) to generate the row-scanning-driving voltage signals, including g1, g2, g3, g4, and g5. The row-scanning-driving voltage signals (g1-g5) are overlapped with the pre-charge control signals (PCC), including PCC1, PCC2, PCC3, PCC4, and PCC5, to obtain the row-scanning-driving voltage signals, including G1, G2, G3, G4, and G5. Afterward, the digital signals (Gm) are transformed into simulated signals (Vgm), i.e., row-scanning-driving voltage, and then are transmitted into the corresponding scanning line (Xm). As such, within the pre-charge time period (Tm), the data voltage (Vs) for displaying the sub-pixel unit 110 is charged to corresponding sub-pixel unit 110 in advance, such that the polarity is inversed, wherein m=1, 2, 3, 4 and 5. This avoids the over-charge issue. As shown in FIGS. 7 and 4*b*, the subpixel $\mathbf{110}_{(2,1)}$ is taken as an example. The data voltage of the previous frame (V1) is charged to be data voltage of the current frame (V3) within pre-charge time period (T2). Thus, the pre-charge time period for each row may be different, which greatly reduce the pre-charge time period (Tm). In this way, the power consumption and the temperature of the driving circuit is reduced, which overcomes the sharpness issue caused by turning on the scanning line in advance.

Compared to the conventional technology, the present disclosure compares the data voltage of the current frame (V3) with the data voltage of the previous frame (V1) of the subpixel $\mathbf{110}_{(2,1)}$, and determines whether the subpixel has to be pre-charged and calculates the pre-charged time period needed. As such, the over-charge issue is avoid, and the power consumption and the temperature of the driving circuit is reduced. At the same time, the sharpness issue of the displayed image is enhanced.

Figure 8:
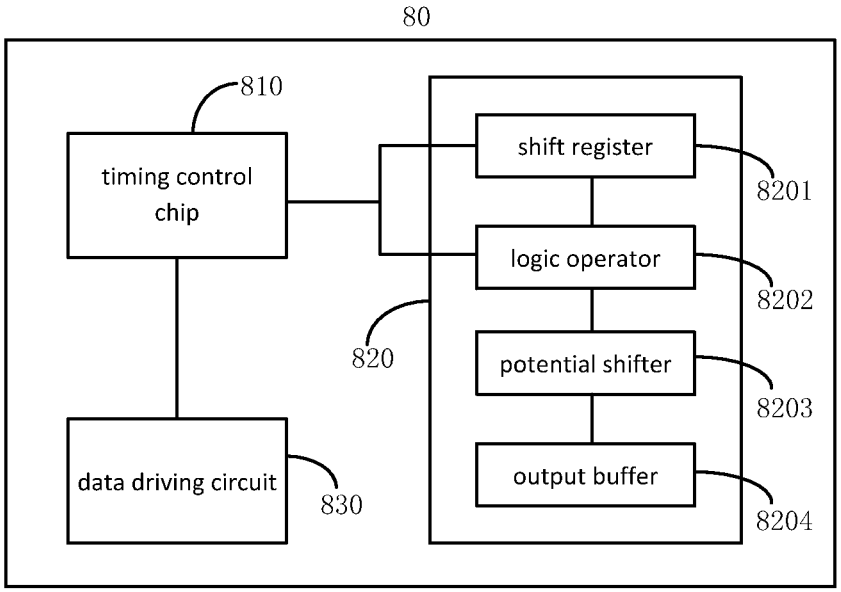
FIG. 8 is a schematic view of the driving circuit of the liquid crystal panel in accordance with a second embodiment.

FIG. 8 is a schematic view of the driving circuit of the liquid crystal panel in accordance with a second embodiment. The driving circuit 80 includes the components below.

A timing control chip 810 receives video signals and analyzes the frame turn-on signals (STV) and corresponding grayscale column data voltage signals (Sn). The timing control chip 810 calculates the column data voltage signals (Sn) in a real-time manner to obtain the pre-charge time period (Tm) needed to display the sub-pixel unit 110. In addition, the pre-charge control signals (PCC) may be obtained in accordance with the pre-charge time period (Tm).

The pre-charge control signals (PCC) includes the row-pre-charge control signals (PCCm) for all of the sub-pixel units 110 of the current frame, which is the same with the first embodiment.

The scanning driving circuit 820 receives the frame turn-on signals (STV) to generate row-scanning-driving voltage signals (gm), and receives the pre-charge control signals (PCC). The scanning driving circuit 820 overlaps the pre-charge control signals (PCC) and the row-scanning-driving voltage signals (gm) and transforms into the row-scanning-driving voltage (VGm). Afterward, the row-scanning-driving voltage (VGm) is transmitted to the corresponding scanning line (Xm). The timing control chip 810 calculates the pre-charge time period (Tm) of the sub-pixel unit 110 in accordance with the column data voltage signals (Sn). The timing control chip 810 may obtain the pre-charge control signals (PCC) of the previous frame in accordance with the pre-charge time period (Tm). Specifically, the column data voltage signals (Sn) of the previous frame of the subpixel $\mathbf{110}_{(2,1)}$ is analyzed in the real-time manner to obtain a first data voltage, such as V1. The column data voltage signals (Sn) of the subpixels of the current frame of the subpixel $\mathbf{110}_{(2,1)}$ is analyzed in the real-time manner to obtain a second data voltage, such as V2, and the subpixels are located in a previous column and in the corresponding same row. The column data voltage signals (Sn) of the subpixels of the current frame of the subpixel $\mathbf{110}_{(2,1)}$ is analyzed in the real-time manner to obtain a third data voltage, such as V3. In addition, a needed pre-charge time period (Tm) is calculated for charging from the first data voltage (V1) to the third data voltage (V3) in accordance with the second data voltage (V2) in the real-time manner so as to adopt the pre-charge time period (Tm) as a time period of the pre-charge control signals to obtain pre-charge control signals (PCC). Specifically, the pre-charge time period (Tm) is adopted as the time period (or the width of the pulse) of the pre-charge control signals (PCC) so as to obtain the pre-charge control signals, which is the same with the first embodiment.

It can be understood that, as shown in FIGS. 6 and 7, the charging time periods respectively for the conditions from the first data voltage (V1) to the second data voltage (V2), and from the second data voltage (V2) to the third data voltage (V3), are dependent from the first data voltage, the second voltage, and the third voltage. Under the circumstance V1<V2<V3, the charging time period for the condition of charging the first data voltage (V1) until the third data voltage (V3) in accordance with V2 is represented as "$T^{/}$". Under the circumstance V1<V3<V2, the charging time period for the condition of charging the first data voltage (V1) until the third data voltage (V3) in accordance with V2 is represented as "$T^{//}$". In general, is different from $T^{//}$. Under the circumstance that V1 equals V3, there is no need to inverse the polarity of the subpixel. Thus, for the subpixel units 110 located in different rows, it is needed to compare the third data voltage of the previous frame with the second data voltage of the corresponding column of the current frame and the first data voltage of the previous frame. Afterward, it is determined whether the subpixel has to be pre-charged and the pre-charged time period is calculated.

The scanning driving circuit 820 includes a shift register 8201, a logic operator 8202, and a potential shifter 8203.

The shift register 8201 receives the frame turn-on signals (STV) and generates the row-scanning-driving voltage signals (gm).

The logic operator 8202 receives the pre-charge control signals (PCC) and overlaps the pre-charge control signals (PCC) and the row-scanning-driving voltage signals (gm) to obtain the row-scanning-driving signals (Gm).

The scanning driving circuit 820 transforms the row-scanning-driving signals (Gm) to row-scanning-driving voltage (VGm) so as to transmit the row-scanning-driving voltage (VGm) to the corresponding scanning line (Xm).

The row-scanning-driving voltage signals (gm), the pre-charge control signals (PCC), and the row-scanning-driving signals (Gm) are digital signals, and are transformed by the potential shifter 8203 to be the simulated voltage (VGm) having a high potential. Afterward, the simulated voltage (VGm) is transmitted to the corresponding scanning line (Xm) to turn on the field effect transistor (T).

The scanning driving circuit 820 further includes an output buffer 8204.

The output buffer 8204 enhances the driving capability of the row-scanning-driving voltage (VGm). For instance, the output buffer 8204 increases the input current, and then transmits the enhanced row-scanning-driving voltage (VGm) to the corresponding scanning line (Xm).

In addition, the driving circuit 80 further includes a data driving circuit 830 receiving the column data voltage signals (Sn), transforming the column data voltage signals (Sn) to the data voltage VSn, and transmitting the data voltage to the data line (Yn).

The row data voltage signals (Sn) is also the digital signals being transformed into simulated data voltage (Vsn) by the data driving circuit, and then are transmitted to the corresponding data line (Yn). In this way, the sub-pixel unit 110 located in the data line (Yn) are pre-charged and the polarity is inversed.

In view of the conventional technology and the first embodiment, the present disclosure compares the third data voltage to be written to the next subpixel with the second data voltage of the corresponding column of the current frame and the first data voltage of the previous frame. Afterward, it is determined whether the current subpixel needed to be pre-charged or the pre-charge time period needed for charging from the first data voltage to the third data voltage in accordance with the second data voltage is calculated in the real-time manner. As such, the pre-charge time period of the subpixel in all rows are prevented from the over-charge issue. In this way, the power consumption and the temperature of the driving circuit is reduced, and the sharpness of the display images is enhanced.

Figure 9:
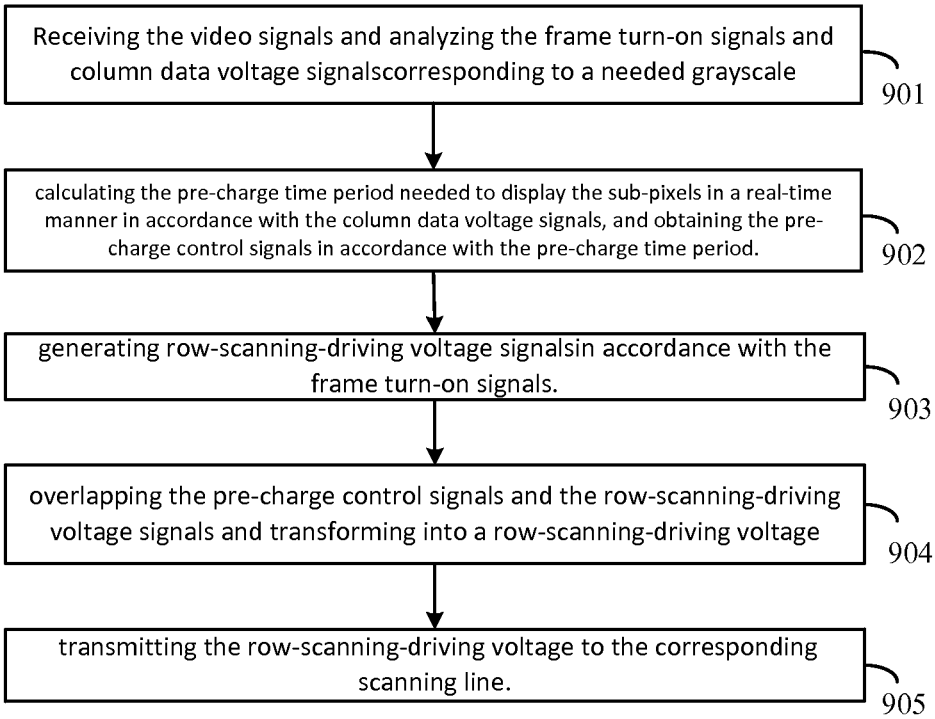
FIG. 9 is a schematic view of the driving circuit of the liquid crystal panel in accordance with a third embodiment.

FIG. 9 is a schematic view of the driving circuit of the liquid crystal panel in accordance with a third embodiment. The method includes the following steps.

In block 901, the driving circuit receives the video signals and analyzes the frame turn-on signals and the column data voltage signals corresponding to a needed grayscale.

In block 902, the pre-charge time period needed to display the sub-pixel is calculated in a real-time manner in accordance with the column data voltage signals. In addition, the pre-charge control signals may be obtained in accordance with the pre-charge time period.

In block 903, row-scanning-driving voltage signals are generated in accordance with the frame turn-on signals.

In block 904, the pre-charge control signals and the row-scanning-driving voltage signals are overlapped and are transformed into a row-scanning-driving voltage.

In block 905, the row-scanning-driving voltage is transmitted to the corresponding scanning line.

The above method corresponds to operations of the driving circuit 50 in the first embodiment. Specifically, the block 901 and 902 correspond to the operations of the timing control chip 510, and the block 903 and 904 correspond to the operations of the timing control chip 520.

Figure 10:
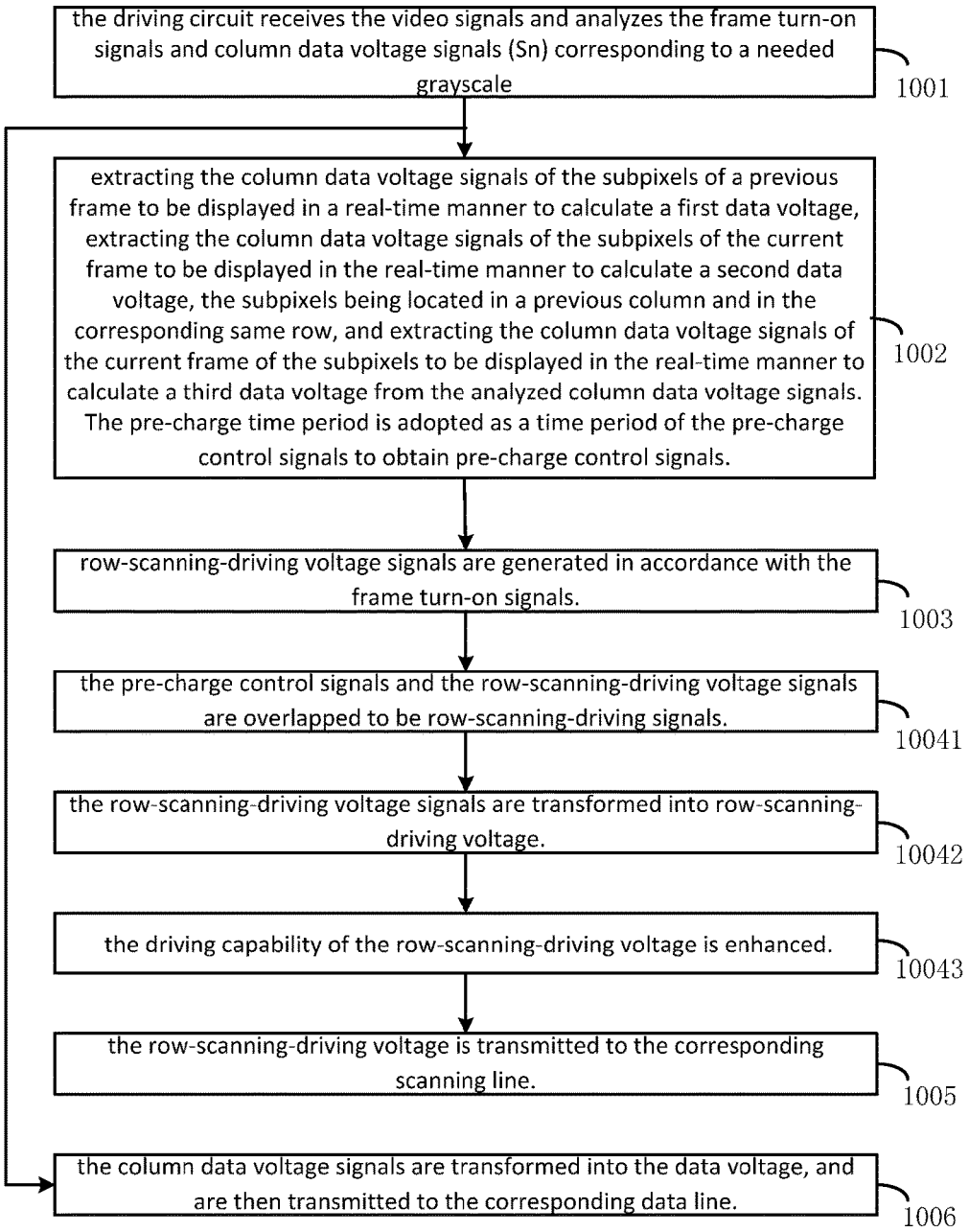
FIG. 10 is a flowchart illustrating the driving method of the liquid crystal panel in accordance with a fourth embodiment.

FIG. 10 is a flowchart illustrating the driving method of the liquid crystal panel in accordance with a fourth embodiment.

In block 1001, the driving circuit receives the video signals and analyzes the frame turn-on signals and column data voltage signals (Sn) corresponding to a needed grayscale.

In block 1002, extracting the column data voltage signals of the subpixels of a previous frame to be displayed in a real-time manner to calculate a first data voltage, extracting the column data voltage signals of the subpixels of the current frame to be displayed in the real-time manner to calculate a second data voltage, the subpixels being located in a previous column and in the corresponding same row, and extracting the column data voltage signals of the current frame of the subpixels to be displayed in the real-time manner to calculate a third data voltage from the analyzed column data voltage signals. The pre-charge time period is adopted as a time period of the pre-charge control signals to obtain pre-charge control signals.

In block 1003, row-scanning-driving voltage signals are generated in accordance with the frame turn-on signals.

In block 1004, the pre-charge control signals and the row-scanning-driving voltage signals are overlapped and are transformed into a row-scanning-driving voltage.

In block 1005, the row-scanning-driving voltage is transmitted to the corresponding scanning line.

The above method corresponds to operations of the driving circuit 80 in the second embodiment. Specifically, the block 1001 and 1002 correspond to the operations of the timing control chip 810, and the block 1003 and 1004 correspond to the operations of the timing control chip 820.

The block 1004 further includes block 10041 and 10042.

In block 10041, the pre-charge control signals and the row-scanning-driving voltage signals are overlapped to be row-scanning-driving signals.

In block 10042, the row-scanning-driving voltage signals are transformed into row-scanning-driving voltage.

In addition, the block 1004 further includes a block 10043.

In block 10043, the driving capability of the row-scanning-driving voltage is enhanced.

In addition, a block 1006 is configured after the block 1001 and before the block 1005.

In block 1006, the column data voltage signals are transformed into the data voltage, and are then transmitted to the corresponding data line.

It can be understood that the block 1006 of transmitting the data voltage to the corresponding data line is executed simultaneously with the block 1005.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A driving circuit of liquid crystal panels, comprising:

a timing control chip receiving video signals and analyzing frame turn-on signals and column data voltage signals corresponding to a needed grayscale;

calculating a pre-charge time period needed for displaying the subpixels to be displayed in a real-time manner in accordance with the column data voltage signals, and obtaining pre-charge control signals in accordance with the pre-charge time period;

a scanning driving circuit receiving the frame turn-on signals and generating the row-scanning-driving voltage signals, receiving the pre-charge control signals and overlapping the pre-charge control signals and the row-scanning-driving voltage signals to obtain the row-scanning-driving signals, and transforming the row-scanning-driving signals to the row-scanning-driving voltage so as to transmit the row-scanning-driving voltage to a corresponding scanning line;

wherein the timing control chip extracts the column data voltage signals of the subpixels of a previous frame to be displayed in a real-time manner to calculate a first data voltage, extracts the column data voltage signals of the subpixels of the current frame to be displayed in the real-time manner to calculate a second data voltage, the subpixels being located in a previous column and in the corresponding same row, extracts the column data voltage signals of the current frame of the subpixels to be displayed in the real-time manner to calculate a third data voltage from the analyzed column data voltage signals, and calculates the pre-charge time period for charging from the first data voltage to the third data voltage in accordance with the second data voltage in the real-time manner, and the pre-charge time period is adopted as the a time period of the pre-charge control signals to obtain pre-charge control signals.

2. The driving circuit as claimed in claim 1, wherein the scanning driving circuit comprises a shift register, a logic operator, and a potential shifter, the shift register receiving the frame turn-on signals and generating the row-scanning-driving voltage signals, the logic operator receiving the pre-charge control signals and overlapping the pre-charge control signals and the row-scanning-driving voltage signals to obtain the row-scanning-driving signals, and the scanning driving circuit transforming the row-scanning-driving signals to the row-scanning-driving voltage so as to transmit the row-scanning-driving voltage to a corresponding scanning line.

3. The driving circuit as claimed in claim 2, wherein the scanning driving circuit further comprises an output buffer enhancing a driving capability of the row-scanning-driving voltage and transmitting the enhanced row-scanning-driving voltage to the corresponding scanning line.

4. The driving circuit as claimed in claim 3, wherein the driving circuit further comprises a data driving circuit receiving the column data voltage signals, transforming the column data voltage signals to the data voltage, and transmitting the data voltage to the data line.

5. The driving circuit as claimed in claim 2, wherein the driving circuit further comprises a data driving circuit receiving the column data voltage signals, transforming the column data voltage signals to the data voltage, and transmitting the data voltage to the data line.

6. The driving circuit as claimed in claim 1, wherein the driving circuit further comprises a data driving circuit receiving the column data voltage signals, transforming the column data voltage signals to the data voltage, and transmitting the data voltage to the data line.

7. A driving method of liquid crystal panels, comprising:

(S1) receiving video signals by a driving circuit and analyzing frame turn-on signals and column data voltage signals corresponding to a needed grayscale;

(S2) calculating a pre-charge time period needed for the subpixels to be displayed in accordance with the column data voltage signals in a real-time manner, and obtaining the pre-charge control signals in accordance with the pre-charge time period;

(S3) generating row-scanning-driving voltage signals in accordance with the frame turn-on signals;

(S4) overlapping the pre-charge control signals and the column scanning driving voltage signals, and transforming the row-scanning-driving signals to the row-scanning-driving voltage; and (S5) transmitting the row-scanning-driving voltage to a corresponding scanning line; wherein the step (S2) further comprises:

extracting the column data voltage signals of the subpixels of a previous frame to be displayed in a real-time manner to calculate a first data voltage, extracting the column data voltage signals of the subpixels of the current frame to be displayed in the real-time manner to calculate a second data voltage, the subpixels being located in a previous column and in the corresponding same row, and extracting the column data voltage signals of the current frame of the subpixels to be displayed in the real-time manner to calculate a third data voltage from the analyzed column data voltage signals;

calculating a pre-charge time period needed for charging from the first data voltage to the third data voltage in accordance with the second data voltage in the real-time manner so as to adopt the pre-charge time period as a time period of the pre-charge control signals to obtain pre-charge control signals.

8. The driving method as claimed in claim 7, wherein the step (S4) further comprises:

(S41) adding the pre-charge control signals and row-scanning-driving voltage signals to obtain the row-scanning-driving signals; and (S42) transforming the row-scanning-driving signals to the row-scanning-driving voltage.

9. The driving method as claimed in claim 8, wherein after the step (S42), the method further comprises step (S43) of enhancing a driving capability of the row-scanning-driving voltage.

10. The driving method as claimed in claim 9, wherein after the step (S1) and before the step (S5), the method further comprises:

(S6) transforming the row-scanning-driving signals to the row-scanning-driving voltage so as to transmit the column-scanning-driving voltage to a corresponding scanning line.

11. The driving method as claimed in claim 8, wherein after the step (S1) and before the step (S5), the method further comprises:

(S6) transforming the row-scanning-driving signals to the row-scanning-driving voltage so as to transmit the column-scanning-driving voltage to a corresponding scanning line.

12. The driving method as claimed in claim 7, wherein after the step (S1) and before the step (S5), the method further comprises:

(S6) transforming the row-scanning-driving signals to the row-scanning-driving voltage so as to transmit the column-scanning-driving voltage to a corresponding scanning line.

* * * * *